US009146491B2

(12) United States Patent
Yoshizumi et al.

(10) Patent No.: US 9,146,491 B2
(45) Date of Patent: Sep. 29, 2015

(54) CHARGING DEVICE PROVIDED WITH CLEANER FOR CLEANING ELECTRODE

(71) Applicants: Hikaru Yoshizumi, Handa (JP); Koji Ogawa, Ichinomiya (JP); Motoaki Mushika, Hashima (JP)

(72) Inventors: Hikaru Yoshizumi, Handa (JP); Koji Ogawa, Ichinomiya (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/220,773

(22) Filed: Mar. 20, 2014

(65) Prior Publication Data

US 2014/0294431 A1 Oct. 2, 2014

(30) Foreign Application Priority Data

Mar. 29, 2013 (JP) ..... 2013-074708

(51) Int. Cl.
*G03G 15/02* (2006.01)

(52) U.S. Cl.
CPC ..... *G03G 15/0291* (2013.01); *G03G 15/0258* (2013.01)

(58) Field of Classification Search
CPC ..... G03G 15/0225; G03G 15/0258; G03G 15/0291
USPC ..... 399/100
See application file for complete search history.

(56) References Cited

U.S. PATENT DOCUMENTS 3,875,407 A * 4/1975 Hayne ..... 399/100
2010/0296835 A1 11/2010 Itabashi

FOREIGN PATENT DOCUMENTS

JP H04-024759 U 2/1992
JP 2010-271353 A 12/2010
JP 2011-059618 A 3/2011
JP 2013-114018 A 6/2013

* cited by examiner

*Primary Examiner* — David Bolduc
*Assistant Examiner* — Barnabas Fekete
(74) *Attorney, Agent, or Firm* — Banner & Witcoff, Ltd.

(57) ABSTRACT

There is provided a charging device including: a discharge electrode extending in a first direction; and a cleaning member configured to move in the first direction to clean the discharge electrode. The cleaning member includes a rigid member in contact with the discharge electrode, and a cushion member supporting the rigid member. The cushion member is positioned opposite to the discharge electrode with respect to the rigid member.

10 Claims, 14 Drawing Sheets

CHARGING DEVICE PROVIDED WITH CLEANER FOR CLEANING ELECTRODE

CROSS REFERENCE TO RELATED APPLICATION

This application claims priority from Japanese Patent Application No. 2013-074708 filed Mar. 29, 2013. The entire content of the priority application is incorporated herein by reference.

TECHNICAL FIELD

The present invention relates to a charging device disposed in an electrophotographic image forming apparatus.

BACKGROUND

Conventional electrophotographic image-forming devices produce a developer image on a photosensitive member by first charging the photosensitive member with a charging device, then forming an electrostatic latent image on the photosensitive member and supplying developer thereto. One type of charging device used in this image-forming device is a scorotron charging device provided with a discharge wire and grid wires.

However, foreign matter may become deposited on the discharge wire and grid wires when the photosensitive member is charged, for example. When deposits build up on these wires, the quality of charge applied to the photosensitive member can degrade. For this reason, some scorotron charging devices known in the art are equipped with a cleaning member for removing foreign matter deposited on the discharge wire and grid wires.

In one proposed scorotron charging device, the cleaning member is provided with a sliding member that contacts both the discharge wire and the grid wires (See Japanese Utility Model Application Publication No. H04-24759). The sliding member is configured of a flexible insulation sheet. When the cleaning member in this scorotron charging device is moved, the sliding member slides over the discharge wire and grid wires to clean the same.

SUMMARY

However, since the sliding member in the scorotron charging device described above is configured of a flexible insulation sheet, it is difficult to achieve uniform contact between the sliding member and the discharge wire and grid wires. Consequently, the cleaning member may not be capable of reliably rubbing against the discharge wire and grid wires and, hence, may not sufficiently remove deposits from the same.

In view of the foregoing, it is an object of the present invention to provide a charging device that is capable of reliably cleaning at least one of a discharge electrode and a grid electrode.

In order to attain the above and other objects, there is provided a charging device including a discharge electrode and a cleaning member. The discharge electrode extends in a first direction, and the cleaning member is configured to move in the first direction to clean the discharge electrode. The cleaning member includes: a rigid member in contact with the discharge electrode; and a cushion member supporting the rigid member. The cushion member is positioned opposite to the discharge electrode with respect to the rigid member.

According to another aspect of the present invention, there is also provided a charging device including a discharge electrode, a grid electrode and a cleaning member. The discharge electrode extends in a first direction. The grid electrode extends in the first direction and is disposed in separation from the discharge electrode. The cleaning member is configured to move in the first direction to clean the grid electrode. The cleaning member includes: a rigid member in contact with the grid electrode; and a cushion member supporting the rigid member and configured to surround the grid electrode via the rigid member.

DETAILED DESCRIPTION

First, a drum cartridge 1 will be described. The drum cartridge 1 is provided with a charging unit 2 according to a first embodiment of the present invention.

1. Structure of the Drum Cartridge

Figure 1:
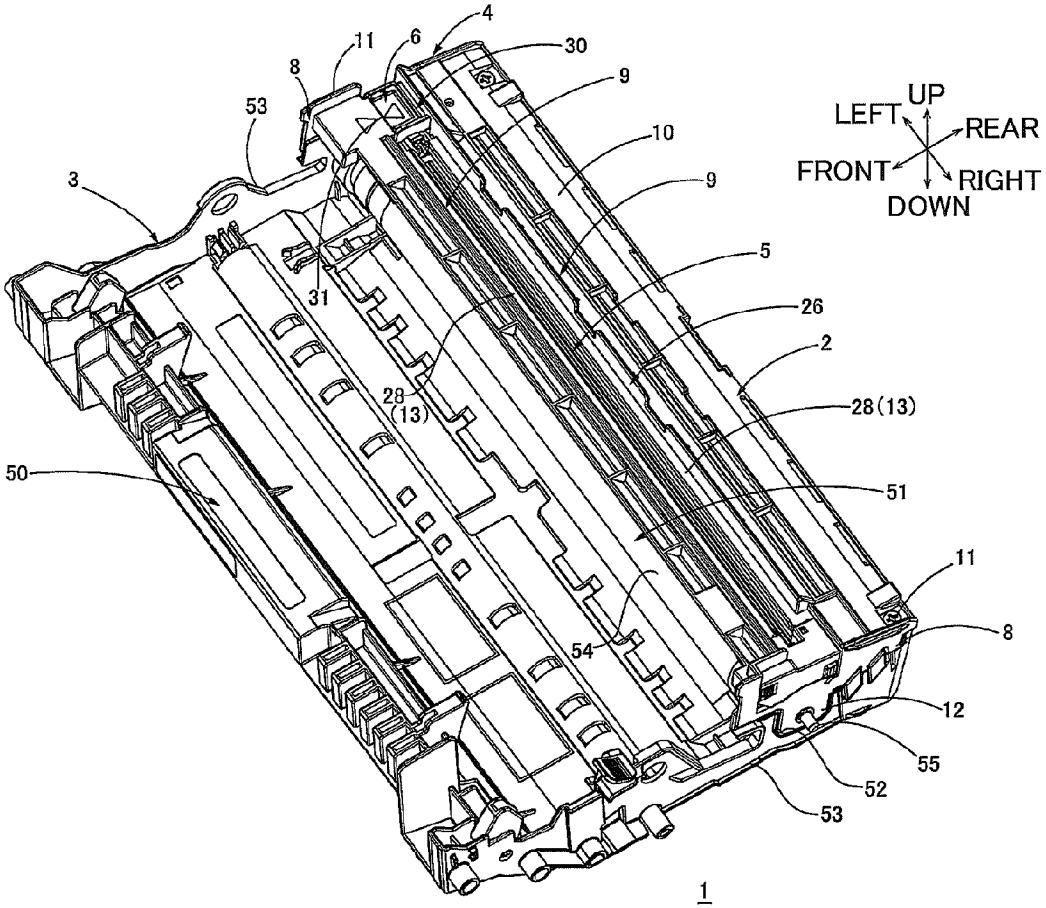
FIG. 1 is an upper right view of a drum cartridge provided with a charging unit according to a first embodiment of the present invention.

As shown in FIG. 1, the drum cartridge 1 includes a drum unit 3, and the charging unit 2.

Directions related to the drum cartridge 1 in the following description will be given under the assumption that the drum cartridge 1 is resting on a level surface, and more specifically will be based on the directional arrows shown in the drawings. Further, forward, rearward, leftward, rightward, upward, and downward directions related to the charging unit 2 will be defined based on the state of the charging unit 2 when the charging unit 2 is mounted in the drum cartridge 1 resting on a level surface.

(1-1) Drum Unit

The drum unit 3 includes a drum-unit frame 50, and a photosensitive drum 51.

The drum-unit frame 50 has a box-like shape that is open on the top. The drum-unit frame 50 includes a pair of frame side walls 53.

The frame side walls 53 are arranged parallel to each other and are separated in a left-right direction. The frame side walls 53 have a plate shape that is generally rectangular in a side view and elongated in a front-rear direction. Each frame side wall 53 has a grooved part 52.

The grooved parts 52 are respectively formed in the outer left-right surfaces of the corresponding frame side walls 53, in the rear portions thereof. The grooved parts 52 have a general U-shape in a side view that is open on the top. The grooved parts 52 are recessed inward in the respective left-right outer surfaces of the frame side walls 53.

While not shown in the drawings, each of the frame side walls 53 includes a through-hole formed in the approximate center region of the grooved part 52 when viewed from the side. The through-holes penetrate the respective frame side walls 53 in the left-right direction.

The photosensitive drum 51 includes a drum body 54, and a drum shaft 55.

The drum body 54 is disposed between rear portions of the frame side walls 53. The drum body 54 has a general cylindrical shape that is elongated in the left-right direction. More specifically, the drum body 54 includes a base metal tube having a general cylindrical shape, and a photosensitive resin layer coating the surface of the metal tube.

The drum shaft 55 is formed of a metal in a general columnar shape that is elongated in the left-right direction. The drum shaft 55 has a left-right length greater than the left-right dimension of the drum body 54. The drum shaft 55 penetrates the drum body 54 in the left-right direction and is aligned with the center axis of the same. Both left and right ends of the drum shaft 55 protrude outward in corresponding left and right directions from the drum body 54. The drum shaft 55 and drum body 54 are capable of rotating relative to each other.

The left and right ends of the drum shaft 55 are received in the through-holes (not shown) formed in the frame side walls 53 of the drum-unit frame 50 and through-holes 16 formed in frame side walls 8 of a charging-unit frame 4 (described later) so as to be incapable of rotating relative to the same. With this configuration, the frame side walls 53 support the photosensitive drum 51, with the drum body 54 capable of rotating relative to the drum-unit frame 50.

(1-2) Charging Unit

The charging unit 2 includes the charging-unit frame 4, a scorotron charger 5, and a cleaner 6.

The charging-unit frame 4 includes a pair of frame side walls 8, a charger support part 26, and a top wall 10.

Figure 2:
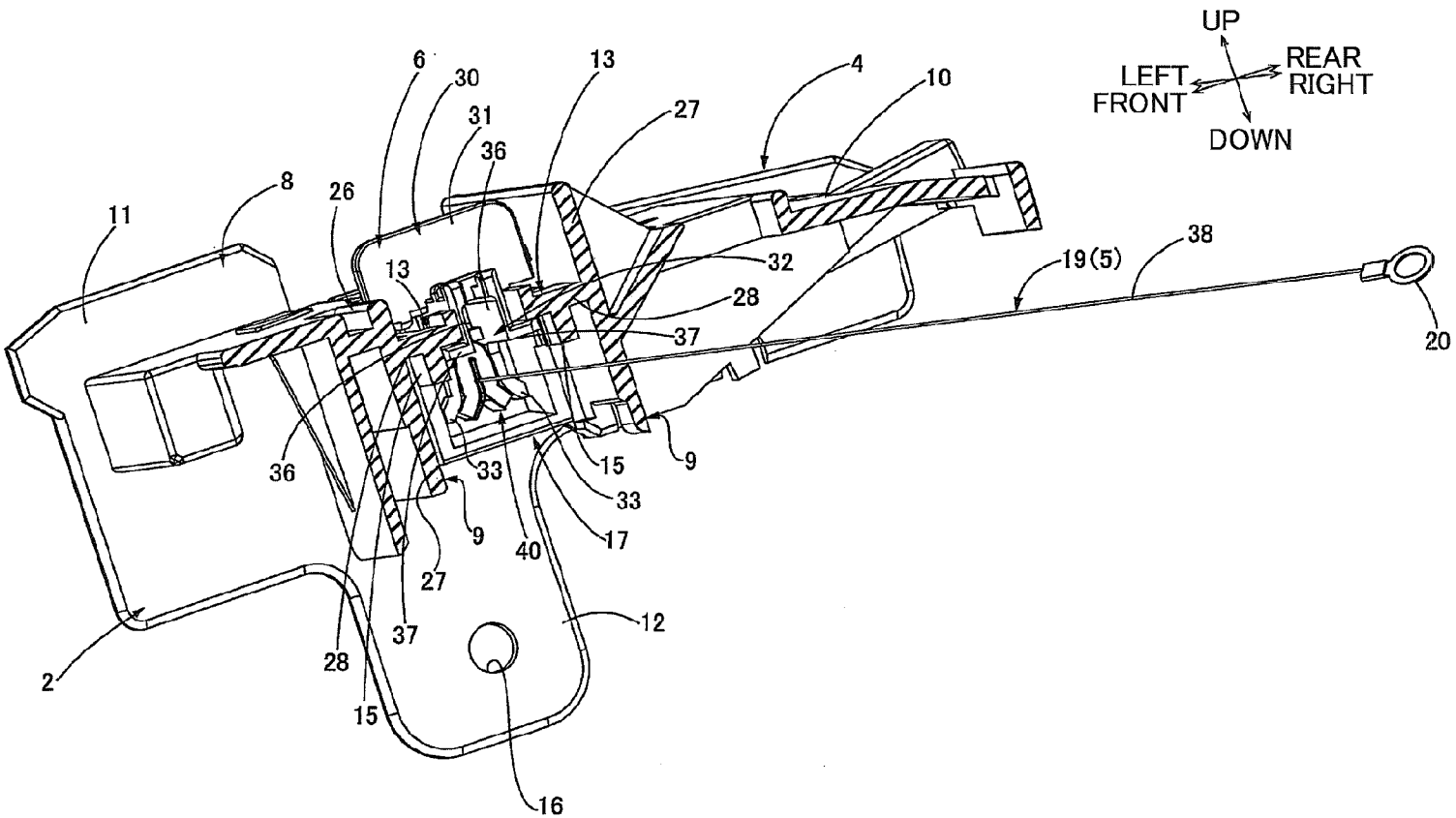
FIG. 2 is a side cross-sectional view of the charging unit according to the first embodiment as viewed from its front and right side, the charging unit including a cleaner, a discharge wire, and a grid electrode.

The frame side walls 8 are arranged parallel to each other and are separated in the left-right direction. As shown in FIG. 2, each of the frame side walls 8 includes a body part 11, and a protruding part 12.

The body parts 11 have a plate shape that is generally rectangular in a side view and elongated in the front-rear direction. The protruding parts 12 are provided in positions corresponding to the grooved parts 52 formed in the frame side walls 53. The protruding parts 12 are generally rectangular in a side view with a shape similar to the grooved parts 52. The protruding parts 12 protrude downward from bottom edges of the respective body parts 11 in an approximate front-rear center region thereof. Each protruding part 12 has a through-hole 16.

The through-holes 16 are generally circular in a side view and penetrate the center portion of the respective protruding parts 12 in the left-right direction.

The charger support part 26 is disposed between the approximate front-rear center regions of the body parts 11 constituting the frame side walls 8. The charger support part 26 is configured of a pair of grid support parts 17, and a pair of cleaner support parts 9.

The grid support parts 17 are disposed adjacent to the respective body parts 11 on the inner left-right sides thereof and are positioned to correspond to the left and right ends of a grid 18 described later. The grid support parts 17 have a general U-shape in a side view that is open on the top. The grid support parts 17 are positioned in the approximate front-rear center regions on the inner left-right surfaces of the corresponding body parts 11 and protrude inward relative to the left-right direction.

The cleaner support parts 9 are spaced apart from each other in the front-rear direction so as to sandwich the pair of grid support parts 17 from the front and rear sides thereof. The cleaner support parts 9 bridge the body parts 11 of the frame side walls 8. Each of the cleaner support parts 9 includes a vertical wall 27, and a guide part 13.

The vertical wall 27 has a plate shape that is generally rectangular in a front view and elongated in the left-right direction. The left and right ends of the vertical wall 27 are connected to the inner left and right surfaces of the corresponding body parts 11 constituting the frame side walls 8.

The guide parts 13 are configured to guide movement of the cleaner 6. Each guide part 13 includes a rail part 28, and a protrusion 15.

The rail part 28 has a general L-shape in a side view. That is, the rail part 28 extends inward relative to the front-rear direction from the inner front-rear surface of the corresponding vertical wall 27, then bends and extends upward. The rail part 28 also extends across the entire left-right length of the vertical wall 27. As shown in FIG. 5B, the rail part 28 slopes slightly upward from the left end toward the right end.

As illustrated in FIG. 2, the rail part 28 of the front guide part 13 and the rail part 28 of the rear guide part 13 are aligned with each other in the front-rear direction and are spaced apart from each other in the front-rear direction.

The protrusion 15 has a general rectangular shape in a side view. The protrusion 15 protrudes downward from the approximate front-rear center region on the bottom surface of the corresponding rail part 28 and extends across the entire left-right dimension of the rail part 28.

The top wall 10 has a plate shape that is generally rectangular in a plan view and elongated in the left-right direction. The top wall 10 protrudes rearward from the vertical wall 27 of the rear cleaner support part 9. The left and right ends of the top wall 10 are coupled to the inner left-right surfaces of the body parts 11 constituting the corresponding frame side walls 8.

As shown in FIG. 1, the charging-unit frame 4 is disposed on the rear portion of the drum-unit frame 50 such that the protruding parts 12 of the frame side walls 8 are fitted into the corresponding grooved parts 52 from above. In this state, the through-holes 16 formed in the frame side walls 8 of the charging-unit frame 4 communicate in the left-right direction with the through-holes (not shown) formed in the frame side walls 53.

The scorotron charger 5 is supported on the charger support part 26 of the charging-unit frame 4. The scorotron charger 5 includes a grid 18, and a discharge wire 19.

Figure 4:
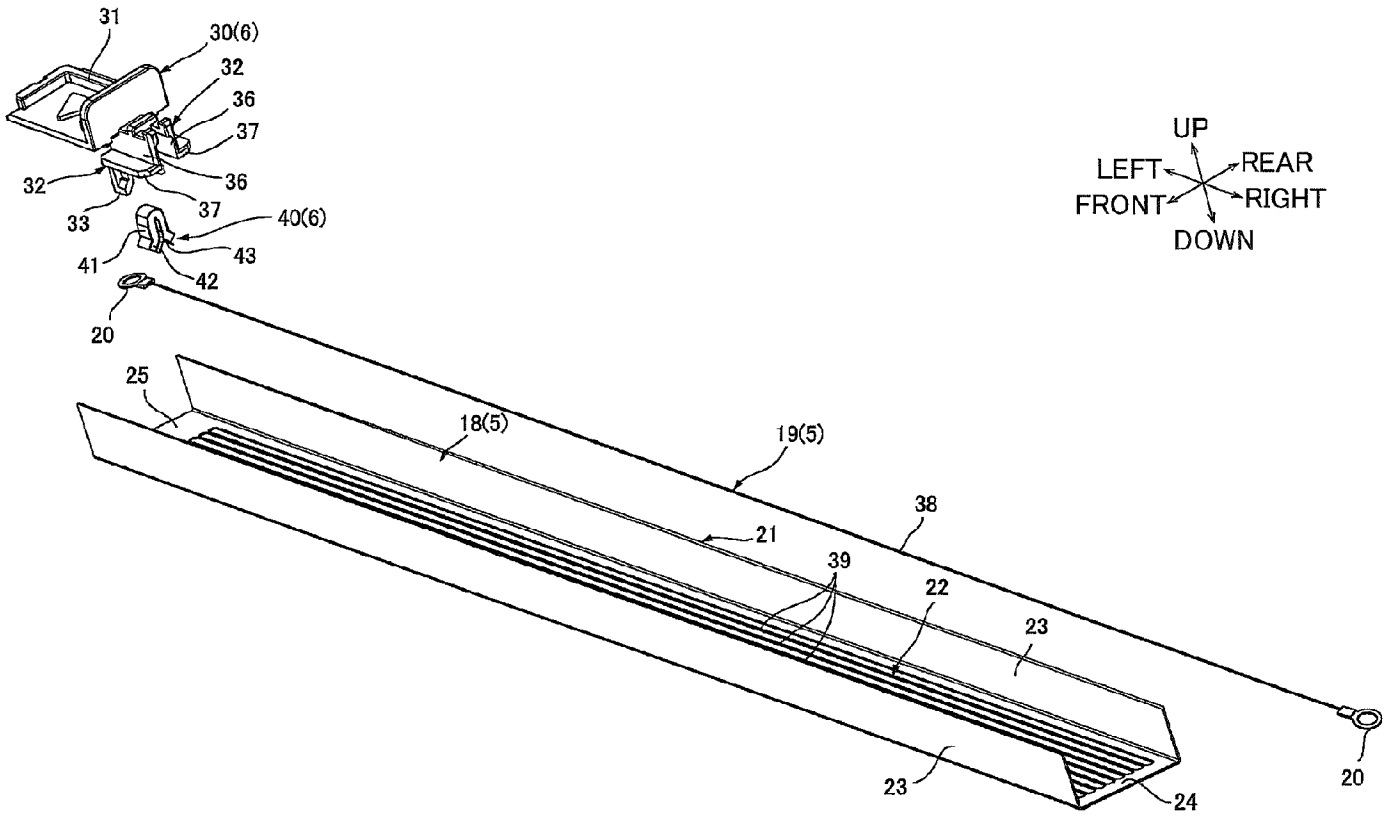
FIG. 4 is an exploded perspective view of the cleaner, the discharge wire and the grid electrode shown in FIG. 2 when viewed from their upper and right side.

As shown in FIG. 4, the grid 18 includes a frame part 21, and a ridged part 22.

The frame part 21 has a general square U-shape in a side view, with the opening of the "U" facing upward, and is elongated in the left-right direction. The frame part 21 includes a pair of side plates 23, a right bottom plate 24, and a left bottom plate 25.

The side plates 23 are arranged parallel to each other and are separated in the front-rear direction. The side plates 23 have a plate shape that is generally rectangular in a front view and elongated in the left-right direction.

The right bottom plate 24 has a plate shape that is generally rectangular in a plan view and elongated in the front-rear direction. The right bottom plate 24 couples the bottom edges of the side plates 23 in the front-rear direction at the right end thereof.

The left bottom plate 25 has a plate shape that is generally rectangular in a plan view and elongated in the front-rear direction. The left bottom plate 25 couples the bottom edges of the side plates 23 in the front-rear direction at the left end thereof.

The ridged part 22 is disposed between the right bottom plate 24 and left bottom plate 25. The ridged part 22 is configured of a plurality of ridge members 39 extending linearly in the left-right direction and juxtaposed at intervals in the front-rear direction. Each of the ridge members 39 is connected to the right bottom plate 24 at the right end and to the left bottom plate 25 at the left end.

Figure 8:
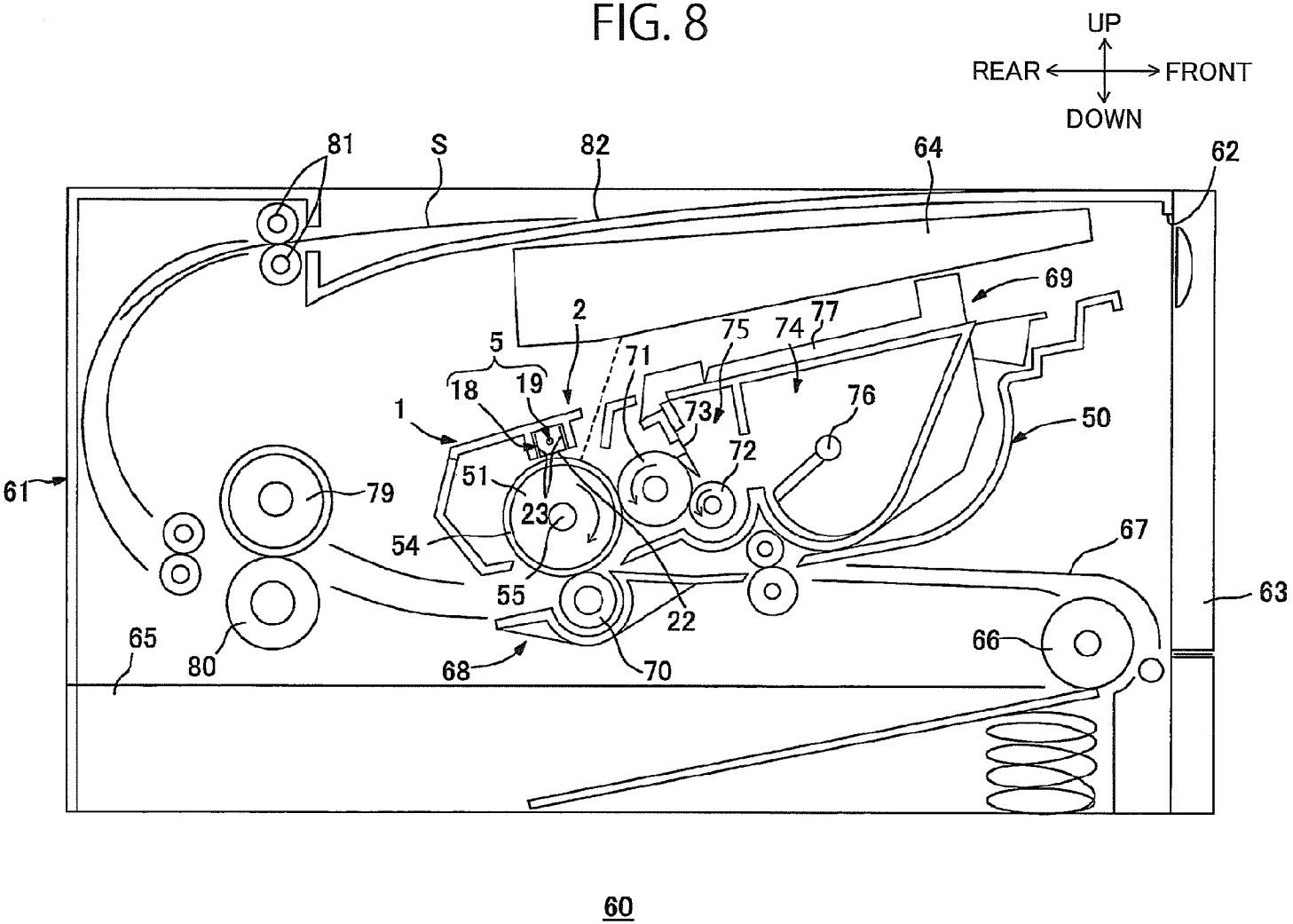
FIG. 8 is a central cross-sectional view of a printer provided with the drum cartridge shown in FIG. 1.

The left and right ends of the grid 18 are fitted into the corresponding grid support parts 17. With this configuration, the charging-unit frame 4 supports the grid 18 between the pair of cleaner support parts 9 in the front-rear direction and between the pair of frame side walls 8 in the left-right direction. As shown in FIG. 8, the ridged part 22 of the grid 18 confronts but is separated from the top of the photosensitive drum 51.

As shown in FIG. 4, the discharge wire 19 extends in the left-right direction and includes a wire 38, and a pair of ring hooks 20.

The wire 38 is formed of tungsten, for example. One of the ring hooks 20 is provided on each end of the wire 38. The ring hooks 20 have a general annular shape.

The ring hooks 20 of the discharge wire 19 are engaged with engaging parts (not shown) provided in the grid support parts 17. In this way, the charging-unit frame 4 supports the discharge wire 19 in a taut state. As shown in FIG. 8, the wire 38 of the discharge wire 19 is arranged at a position between and separated from the side plates 23 of the grid 18 with respect to the front-rear direction and at a position above and separated from the ridged part 22 of the grid 18. The wire 38 of the discharge wire 19 is also positioned between a pair of sandwiching parts 33 described later.

As shown in FIG. 4, the cleaner 6 includes a retaining frame 30, and a cleaning member 40.

The retaining frame 30 includes an operating part 31, a pair of coupling parts 32, and the pair of sandwiching parts 33.

The operating part 31 has a plate shape that is generally L-shaped in a front view and is elongated in the front-rear direction.

The coupling parts 32 are disposed to the lower right of the operating part 31. The upper left ends of the coupling parts 32 are coupled to the operating part 31. The coupling parts 32 are spaced apart in the front-rear direction. The coupling parts 32 have a plate shape that is generally L-shaped in a side view and elongated in the left-right direction.

More specifically, each of the coupling parts 32 includes a vertical part 36, and a horizontal part 37. The vertical part 36 has a plate shape that is generally rectangular in a front view and elongated in the left-right direction. The horizontal part 37 has a plate shape that is generally rectangular in a plan view and elongated in the left-right direction. The horizontal part 37 is formed continuously with the bottom edge of the corresponding vertical part 36 and protrudes outward in the corresponding front or rear direction.

The left portions of the vertical parts 36 at the top edges thereof are coupled with the bottom right edge of the operating part 31. In other words, the operating part 31 and coupling parts 32 are integrally formed.

Figure 3:
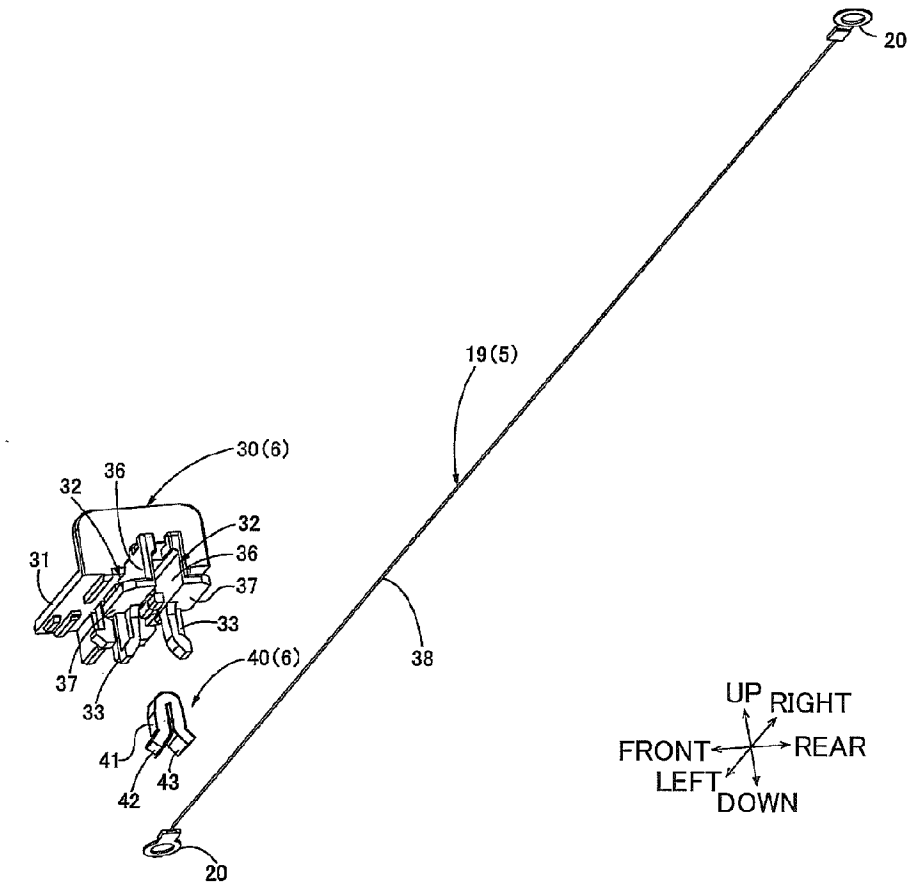
FIG. 3 is an exploded perspective view of the cleaner and the discharge wire shown in FIG. 2 when viewed from their lower-right side.
Figure 6B:
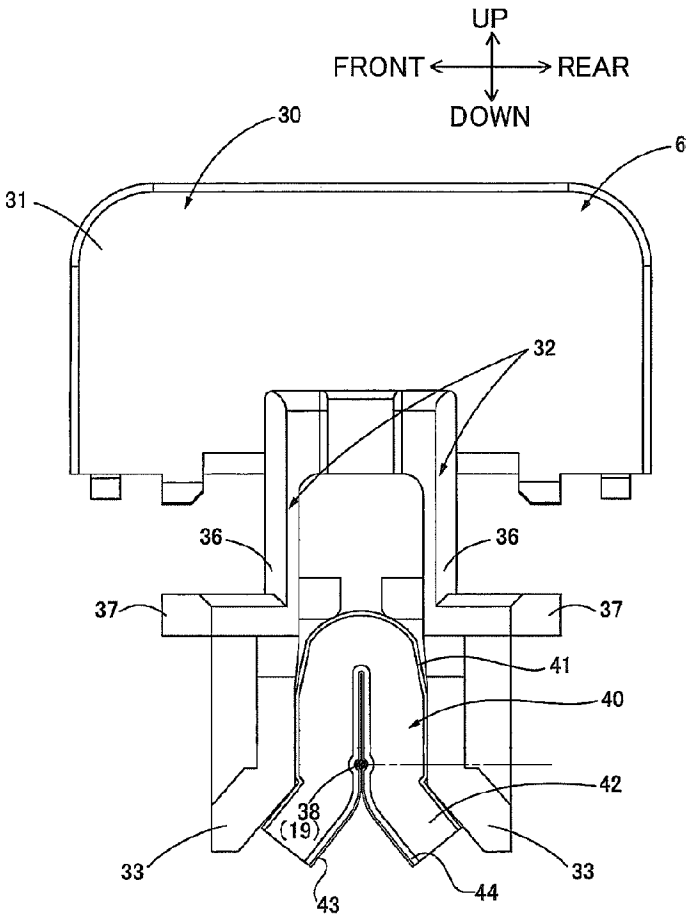
FIG. 6B is a cross-sectional view of the charging unit according to the first embodiment taken along a plane 5C-5C shown in FIG. 5A, wherein the cleaner is at a cleaning position.
Figure 6A:
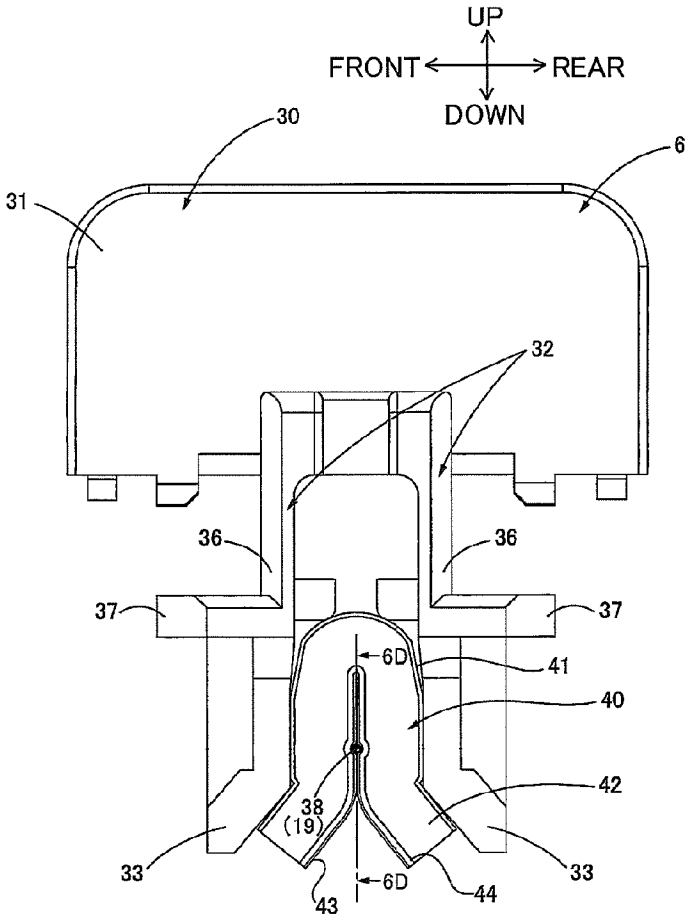
FIG. 6A is a cross-sectional view of the charging unit according to the first embodiment taken along a plane 5B-5B shown in FIG. 5A, wherein the cleaner is at a home position.

As shown in FIG. 3, one of the sandwiching parts 33 is provided on the bottom of each coupling part 32, so that a gap is formed between the sandwiching parts 33 in the front-rear direction. The sandwiching parts 33 have a rail-like shape that is elongated vertically. The sandwiching parts 33 extend downward from the bottom surfaces of the corresponding horizontal parts 37 near the left edge thereof. As shown in FIG. 6A, the bottom ends of the sandwiching parts 33 slope outward in the front-rear direction toward the bottom thereof so that the gap between the sandwiching parts 33 grows larger toward its bottom.

As shown in FIG. 2, the retaining frame 30 is arranged between the pair of vertical walls 27 such that both the front and rear horizontal parts 37 are positioned below the corresponding rail parts 28, and both the front and rear ends of the operating part 31 are positioned above the corresponding rail parts 28. The horizontal parts 37 are also disposed adjacent to the corresponding protrusions 15 on the inner front-rear sides thereof.

With this configuration, the retaining frame 30 can move in the left-right direction along the rail parts 28, as will be described later in greater detail. However, the retaining frame 30 is normally disposed in a prescribed position (hereinafter called the "home position") wherein the operating part 31 is disposed above the left ends of the guide parts 13.

As shown in FIG. 6A, the cleaning member 40 is folded in half to form a general U-shape in a side view with the opening of the "U" facing downward and is disposed between the pair of sandwiching parts 33. The cleaning member 40 includes a cushion member 42, a first double-sided tape strip 41, a second double-sided tape strip 44, and a rigid member 43.

The cushion member 42 is formed of an elastic foam, such as a urethane sponge. While not shown in the drawings, the cushion member 42 has a rail-like shape that extends in the front-rear direction prior to being mounted in the charging-unit frame 4. Further, the 25% compression load value of the cushion member 42 is preferably between 0.04 and 1.37 MPa, and more preferably between 0.14 and 0.39 MPa. The 25% compression load can be measured using a common compression tester based on the JIS K 6767 standard (as defined by Japan Industrial Standard).

Figure 7:
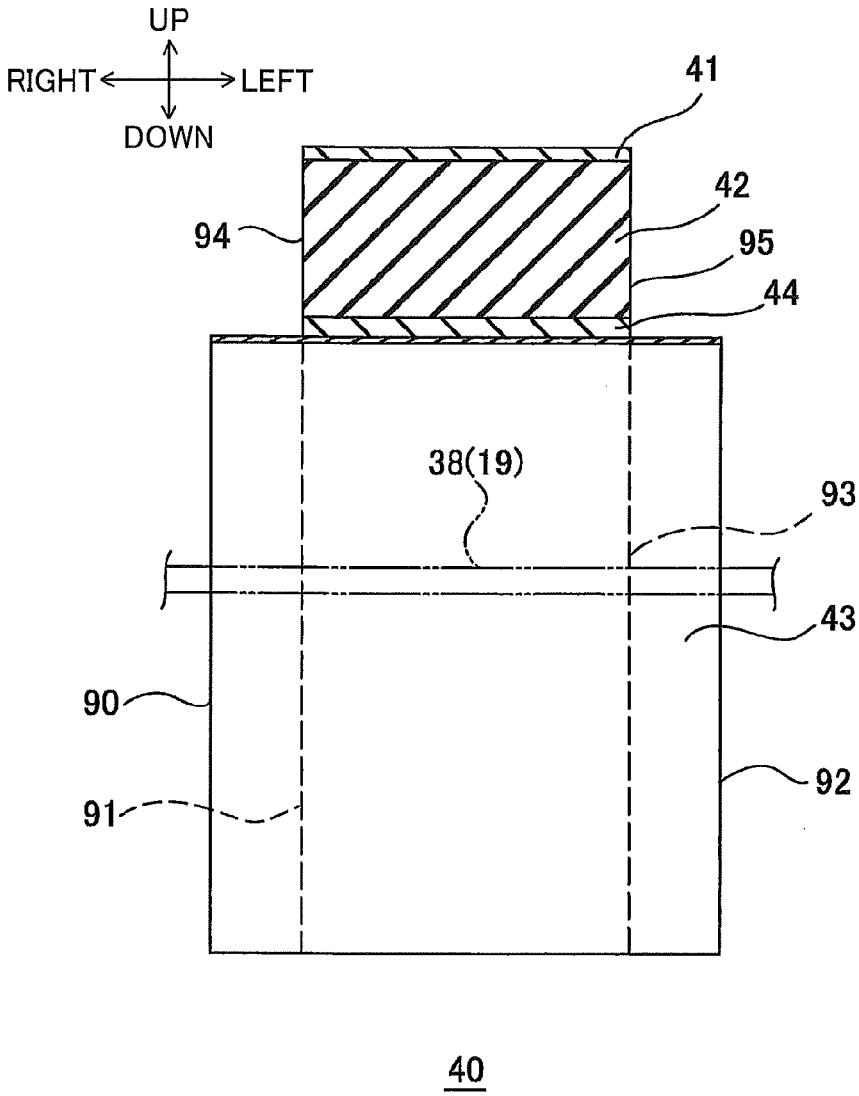
FIG. 7 is a cross-sectional view of a cleaning member of the cleaner taken along a plane 6D-6D shown in FIG. 6A.

The first double-sided tape strip 41 is a strip of tape having adhesive applied to both surfaces and is adhered to the top surface of the cushion member 42. As shown in FIG. 7, the left-right dimension of the first double-sided tape strip 41 is equivalent to that of the cushion member 42.

The second double-sided tape strip 44 is a strip of tape having adhesive applied to both surfaces and is adhered to the bottom surface of the cushion member 42. The left-right dimension of the second double-sided tape strip 44 is equivalent to that of the cushion member 42. Consequently, a right edge 91 of the second double-sided tape strip 44 is aligned with a right edge 94 of the cushion member 42 in the left-right direction, and a left edge 93 of the second double-sided tape strip 44 is aligned with a left edge 95 of the cushion member 42 in the left-right direction.

The rigid member 43 is formed of a polymer film, such as polyethylene terephthalate, polyacetal, or polytetrafluoroethylene. Further, the compressive elasticity modulus of the rigid member 43 (at 25° C.) is between 1 GPa and 10 GPa, and preferably between 2 GPa and 6 GPa, for example. Thus, the rigid member 43 is harder than the cushion member 42. Here, the compressive elasticity modulus can be measured using a common compression tester.

The left-right dimension of the rigid member 43 is greater than that of the cushion member 42.

The rigid member 43 is affixed to the bottom surface of the second double-sided tape strip 44 such that a right edge 90 of the rigid member 43 is positioned further right than the right edge 91 of the second double-sided tape strip 44 and the right edge 94 of the cushion member 42, and a left edge 92 of the rigid member 43 is positioned further left than the left edge 93 of the second double-sided tape strip 44 and the left edge 95 of the cushion member 42. In other words, the right edge 90 of the rigid member 43 is positioned outside the right edge 94 of the cushion member 42 in the left-right direction, and the right edge 91 of the second double-sided tape strip 44 is positioned inside the right edge 90 of the rigid member 43 in the left-right direction. Further, the second double-sided tape strip 44 is fixed to the cushion member 42 and rigid member 43, and the cushion member 42 supports the rigid member 43 through the second double-sided tape strip 44.

As shown in FIG. 6A, the cleaning member 40 is folded in half and positioned between the pair of sandwiching parts 33 such that the rigid member 43 is pressed against the wire 38 of the discharge wire 19 from both sides. By fixing the first double-sided tape strip 41 to the inner front-rear surfaces of the sandwiching parts 33, the first double-sided tape strip 41 is fixed to the sandwiching parts 33. Thus, the cushion member 42 is folded in half with the rigid member 43 nipping the wire 38 of the discharge wire 19.

With this configuration, the rigid member 43 surrounds the entire circumference of the wire 38, making surface contact with the wire 38. Further, the cushion member 42 is positioned opposite to the wire 38 (which the rigid member 43 contacts) with respect to the rigid member 43. By elastically deforming, the cushion member 42 allows the rigid member 43 to deform to conform to the peripheral surface of the wire 38.

2. Cleaning Operation

Next, an operation performed by the cleaner 6 to clean the discharge wire 19 will be described.

In order to clean the discharge wire 19, an operator moves the operating part 31 of the retaining frame 30 rightward from its home position shown in FIG. 1. While holding the cleaning member 40, the retaining frame 30 is guided along the rail parts 28 of the guide parts 13 so as to move slightly upward from left to right. That is, as illustrated in FIG. 5B, the guide parts 13 guide the movement of the cleaner 6 so that a direction X in which the cleaner 6 and, hence, the retaining frame 30 moves is sloped relative to the left-right direction (the horizontal direction). Here, the moving direction X of the cleaner 6 and the left-right direction form an acute angle θ.

Figure 5A:
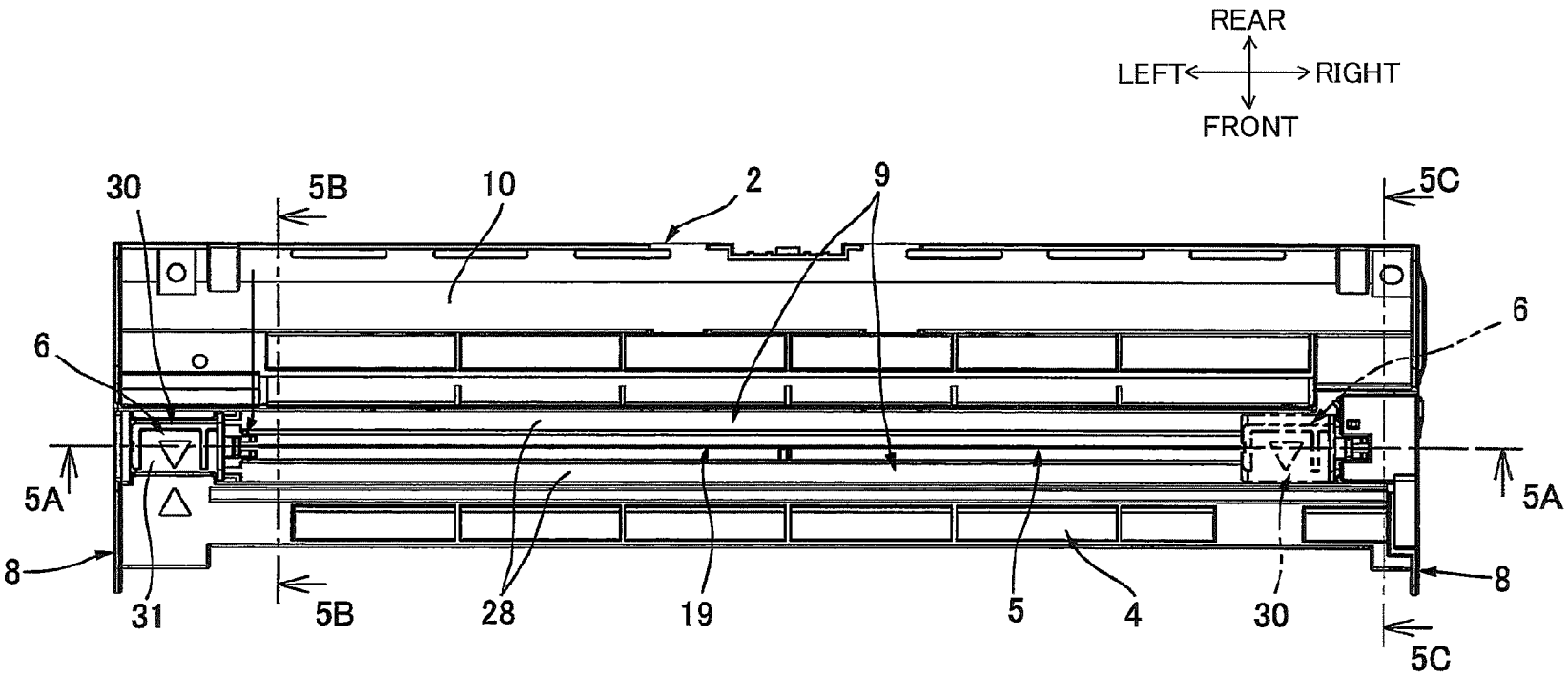
FIG. 5A is a plan view of the charging unit according to the first embodiment.
Figure 5B:
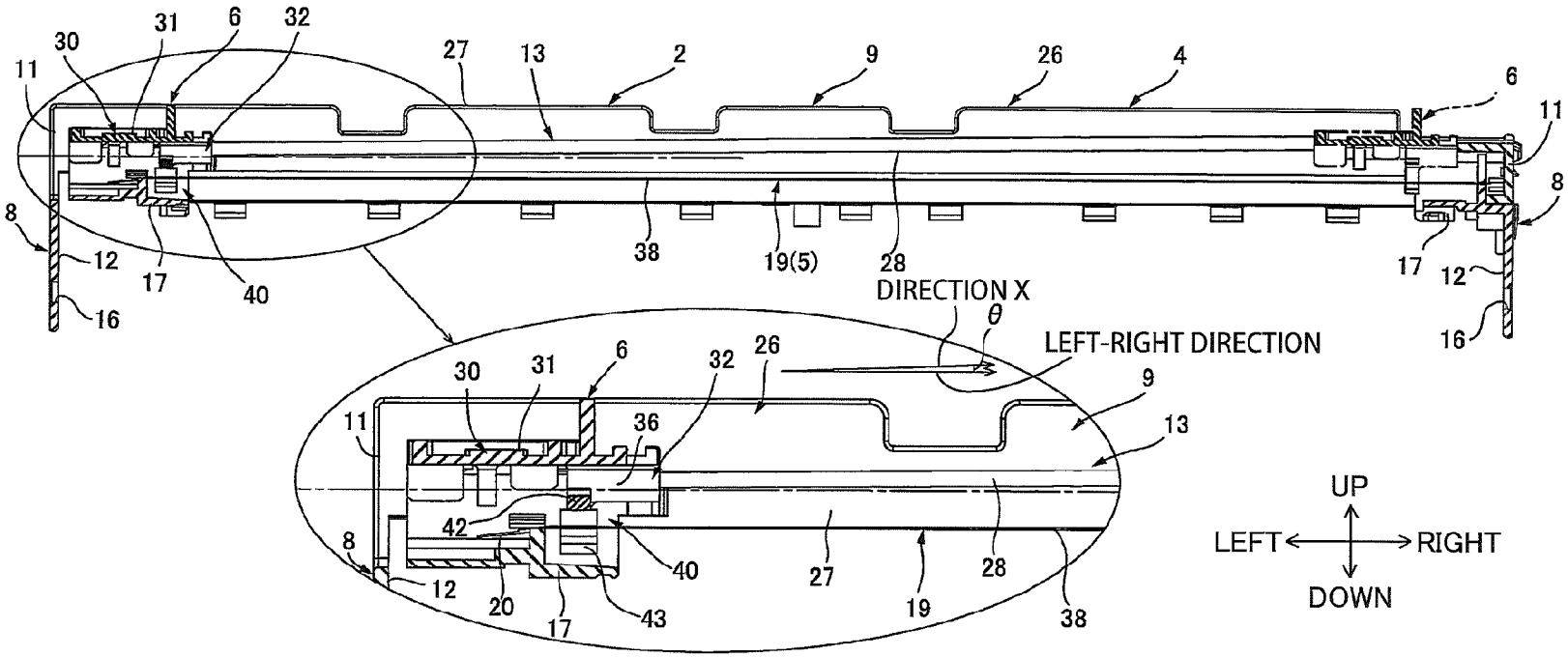
FIG. 5B is a cross-sectional view of the charging unit according to the first embodiment taken along a plane 5A-5A shown in FIG. 5A.

Accordingly, the retaining frame 30 is moved from its home position depicted in solid lines in FIGS. 5A and 5B to a cleaning position depicted in dashed lines in FIGS. 5A and 5B. In the cleaning position, the operating part 31 of the retaining frame 30 is disposed above the right end of the guide parts 13.

While the retaining frame 30 moves from its home position to the cleaning position, the cleaning member 40 held in the retaining frame 30 moves together with the retaining frame 30. Therefore, the cleaning member 40 moves gradually upward relative to the discharge wire 19, as illustrated in FIGS. 6A and 6B.

By sliding over the wire 38 of the discharge wire 19, the rigid member 43 of the cleaning member 40 scrapes deposits off the wire 38, thereby cleaning the discharge wire 19. Once the cleaning operation is complete, the operator returns the retaining frame 30 from the cleaning position to the home position. This ends the operation to clean the discharge wire 19 with the cleaner 6.

3. Overall Structure of a Printer

Next, a printer 60 will be described. The printer 60 is equipped with the drum cartridge 1 described above, which has the charging unit 2 according to the first embodiment of the present invention.

As shown in FIG. 8, the printer 60 includes a generally box-shaped main casing 61. An access opening 62 is formed in one side wall of the main casing 61. A front cover 63 is provided over the access opening 62 on the same side wall. The front cover 63 can be pivoted about its bottom edge in order to expose or cover the access opening 62.

In the following description, the side of the main casing 61 on which the front cover 63 is provided will be called the front side, and its opposite side will be called the rear side. Left and right sides of the main casing 61 will be defined based on the perspective of a user facing the front of the printer 60.

The printer 60 is further provided with a process cartridge 68. The process cartridge 68 includes the drum cartridge 1 described above, and a developing cartridge 69.

The drum cartridge 1 is detachably mounted in the main casing 61. In addition to the photosensitive drum 51 and the scorotron charger 5 described above, the drum cartridge 1 also includes a transfer roller 70.

The developing cartridge 69 is detachably mounted on the drum cartridge 1 while the drum cartridge 1 is mounted in the main casing 61. In this way, the developing cartridge 69 is detachably mounted in the main casing 61. The developing cartridge 69 includes an enclosure 77, an agitator 76, a developing roller 71, a supply roller 72, and a thickness-regulating blade 73.

The internal space of the enclosure 77 is configured to include a toner-accommodating chamber 74, and a developing chamber 75.

The toner-accommodating chamber 74 constitutes a front portion of the interior space in the enclosure 77 and serves to accommodate toner. The developing chamber 75 constitutes a rear portion of the interior space in the enclosure 77.

The agitator 76 is disposed in an approximate front-rear and vertical center region of the toner-accommodating chamber 74. The agitator 76 is capable of rotating relative to the enclosure 77.

The developing roller 71 is disposed in the developing chamber 75 such that a rear surface of the developing roller 71 is exposed outside the enclosure 77. The developing roller 71 can also rotate relative to the enclosure 77.

The supply roller 72 is disposed in the developing chamber 75 and contacts a lower front surface of the developing roller 71 with pressure. The supply roller 72 can also rotate relative to the enclosure 77.

The thickness-regulating blade 73 is disposed in the developing chamber 75 so as to contact an upper front surface of the developing roller 71.

By rotating, the agitator 76 supplies toner from the toner-accommodating chamber 74 onto the supply roller 72 in the developing chamber 75. Next, the rotating supply roller 72 supplies toner received from the agitator 76 onto the developing roller 71. At this time, the toner is positively tribo-charged between the supply roller 72 and developing roller 71. As the developing roller 71 rotates, the thickness-regulating blade 73 regulates the thickness of toner carried on the developing roller 71. As a result, the circumferential surface of the developing roller 71 carries a thin toner layer of uniform thickness.

In the meantime, the discharge wire 19 and grid 18 of the scorotron charger 5 are powered by a power supply (not shown) provided in the main casing 61 to apply a uniform charge of positive polarity to the surface of the photosensitive drum 51 as the photosensitive drum 51 rotates. Next, a scanning unit 64 disposed in an upper section of the main casing 61 selectively irradiates a laser beam (indicated by a dashed line in FIG. 8) toward the positively charged surface of the photosensitive drum 51, forming an electrostatic latent image on the surface of the photosensitive drum 51 based on image data.

Next, the developing roller 71 supplies the positively charged toner carried on its surface to the latent image formed on the surface of the photosensitive drum 51, producing a toner image on the surface of the photosensitive drum 51.

A paper tray 65 detachably mounted in a bottom section of the main casing 61 serves to accommodate sheets S of paper. A pickup roller 66 disposed above the front end of the paper tray 65 rotates and conveys the sheets S from the paper tray 65 along a U-shaped paper-conveying path 67. The sheets S are subsequently conveyed between the photosensitive drum 51 and transfer roller 70 one sheet at a time and at a prescribed timing. At this time, the photosensitive drum 51 and transfer roller 70 work in conjunction to transfer the toner image from the photosensitive drum 51 onto the sheet S, forming an image on the sheet S.

Next, the sheet S is conveyed between a heating roller 79, and a pressure roller 80 disposed in a rear section of the main casing 61. As the sheet S passes between the heating roller 79 and pressure roller 80, the heating roller 79 and pressure roller 80 apply heat and pressure to the sheet S, thermally fixing the image to the sheet S. Subsequently, the sheet S reaches discharge rollers 81 disposed in an upper rear section of the main casing 61. The discharge rollers 81 discharge the sheet S onto a discharge tray 82 formed on a top surface of the main casing 61.

4. Operational and Technical Advantages (1) As shown in FIGS. 6A and 6B, the cushion member 42 holds the rigid member 43, which contacts the wire 38 of the discharge wire 19. Hence, the rigid member 43 can be made to elastically contact the wire 38. Through this elasticity, the rigid member 43 can contact the wire 38 uniformly around its circumference. In other words, the rigid member 43 can be made to contact the wire 38 as if being wrapped around the wire 38 circumferentially.

With this construction, the rigid member 43 can be made to reliably and uniformly scrape the wire 38 of the discharge wire 19 in order to reliably clean the discharge wire 19.

(2) As shown in FIGS. 6A and 6B, the rigid member 43 makes surface contact with the wire 38 of the discharge wire 19 to surround the entire circumference of the wire 38. Hence, this configuration increases the area of contact between the rigid member 43 and wire 38 and can therefore more reliably clean the discharge wire 19.

(3) As shown in FIGS. 6A and 6B, the cushion member 42 is folded in half with the rigid member 43 sandwiching the wire 38 of the discharge wire 19. Accordingly, this simple construction can reliably increase the area of contact between the rigid member 43 and wire 38.

Further, by folding the cushion member 42 in half, the cleaning member 40 can be mounted in the retaining frame 30, thereby facilitating the operation for mounting the cleaning member 40.

(4) As shown in FIG. 7, the right edge 90 of the rigid member 43 is positioned outside (to the right of) the right edge 94 of the cushion member 42 in the left-right direction. Hence, this simple construction can even more reliably increase the area of contact between the rigid member 43 and wire 38.

(5) As shown in FIG. 7, the cleaning member 40 of the cleaner 6 has the second double-sided tape strip 44 for adhering to the rigid member 43 and cushion member 42. Accordingly, the rigid member 43 and cushion member 42 can be reliably fixed together by the second double-sided tape strip 44.

Further, the right edge 91 of the second double-sided tape strip 44 is positioned inside (to the left of) the right edge 90 of the rigid member 43 in the left-right direction. Hence, the rigid member 43 covers the second double-sided tape strip 44 on the side confronting the discharge wire 19, thereby restraining the second double-sided tape strip 44 from contacting the discharge wire 19.

If the second double-sided tape strip 44 were to come into contact with the discharge wire 19, the adhesive of the second double-sided tape strip 44 could become deposited on the discharge wire 19. However, since the rigid member 43 of the first embodiment covers the second double-sided tape strip 44 from the side facing the discharge wire 19, the discharge wire 19 is protected from being contacted by the second double-sided tape strip 44, reducing the likelihood of adhesive becoming deposited on the discharge wire 19. Hence, the above construction can restrain the second double-sided tape strip 44 from coming into contact with the discharge wire 19, while ensuring that the rigid member 43 is reliably fixed to the cushion member 42.

(6) As shown in FIG. 5B, the charging unit 2 is provided with the guide parts 13 for moving the cleaner 6. This construction facilitates the operation for cleaning the discharge wire 19 with the cleaner 6.

Further, the guide parts 13 guide movement of the cleaner 6 so that the moving direction X of the cleaner 6 is sloped relative to the left-right direction. Accordingly, the area of the rigid member 43 that contacts the wire 38 of the discharge wire 19 changes as the cleaner 6 moves, as illustrated in FIGS.

6A and 6B. This arrangement reduces abrasion to the rigid member 43 caused by sliding friction between the rigid member 43 and wire 38.

5. Second Through Fourth Embodiments

(1) Second Embodiment

Figure 9A:
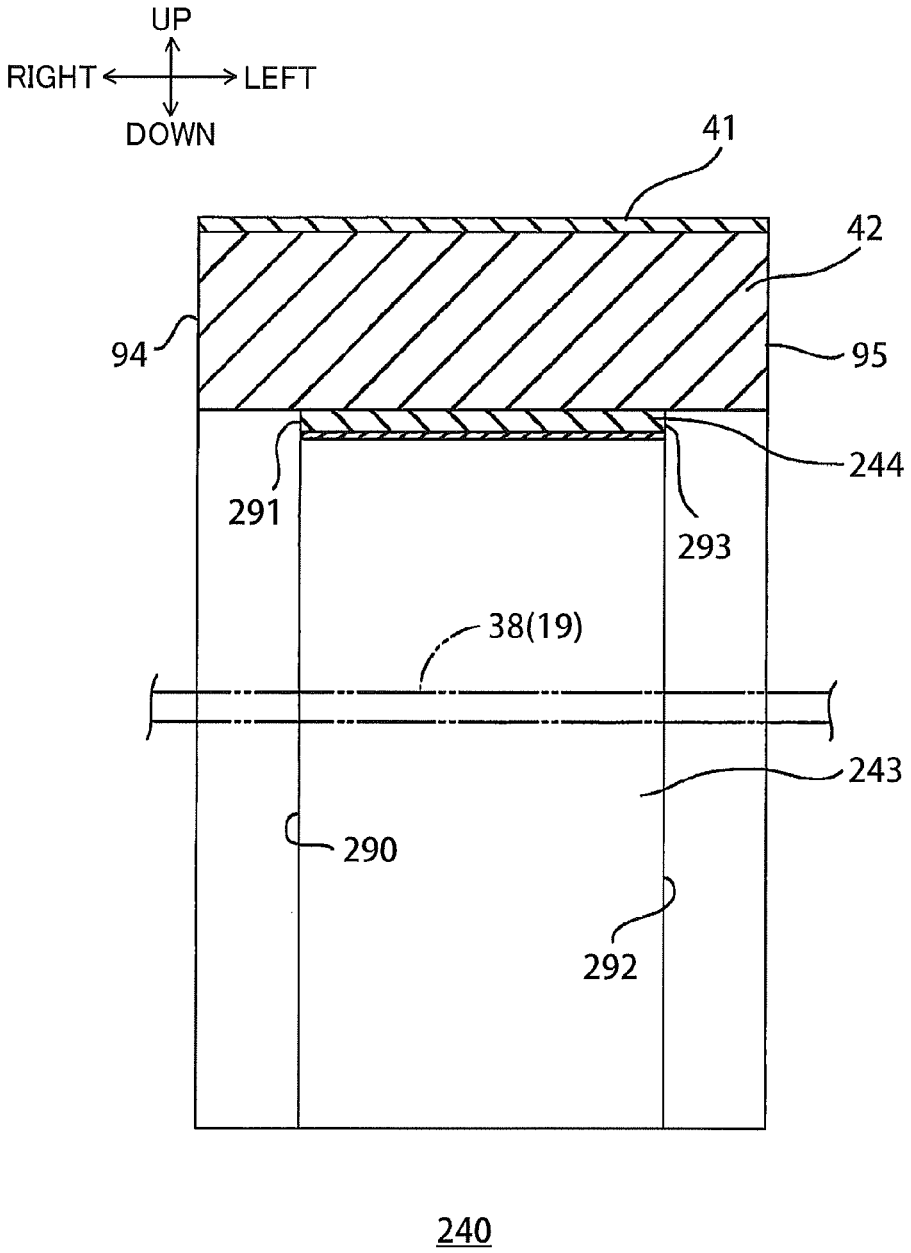
FIG. 9A is a vertical cross-sectional view of a cleaning member according to a second embodiment of the present invention.

Next, a cleaning member 240 according to a second embodiment of the present invention will be described with reference to FIG. 9A. In the following description, like parts and components are designated by the same reference numerals with those of the first embodiment to avoid duplicating description.

In the first embodiment described above, the left-right dimension of the rigid member 43 is larger than the same dimension of the cushion member 42, as shown in FIG. 7. Thus, the right edge 90 of the rigid member 43 is positioned further right than the right edge 94 of the cushion member 42, and the left edge 92 of the rigid member 43 is positioned further left than the left edge 95 of the cushion member 42.

The cleaning member 240 of the second embodiment includes a rigid member 243, a second double-sided tape strip 244 and the cushion member 42. Specifically, the left-right dimension of the rigid member 243 is smaller than the same dimension of the cushion member 42, as illustrated in FIG. 9A. In this case, a right edge 290 of the rigid member 243 is positioned further leftward than the right edge 94 of the cushion member 42, and a left edge 292 of the rigid member 243 is positioned further rightward than the left edge 95 of the cushion member 42.

In addition, the left-right dimension of the second double-sided tape strip 244 is equivalent to that of the rigid member 243. Accordingly, the right edge 290 of the rigid member 243 is aligned with a right edge 291 of the second double-sided tape strip 244, and the left edge 292 of the rigid member 243 is aligned with a left edge 293 of the second double-sided tape strip 244 with respect to the left-right direction.

With the configuration according to the second embodiment, the right edge 290 of the rigid member 243 is positioned further leftward (i.e., inward in the left-right direction) than the right edge 94 of the cushion member 42, and the left edge 292 of the rigid member 243 is positioned further rightward (i.e., inward in the left-right direction) than the left edge 95 of the cushion member 42. Therefore, even when filings from the rigid member 243 are produced through abrasion between the rigid member 243 and the wire 38 of the discharge wire 19 as the number of cleaning operations accumulates, the right edge 94 and left edge 95 of the cushion member 42 can remove these filings during the cleaning operation. Hence, this configuration restrains filings produced from the rigid member 243 from becoming deposited on the discharge wire 19.

The configuration according to the second embodiment described above can obtain the same operational advantages described in the first embodiment.

(2) Third Embodiment

Figure 9B:
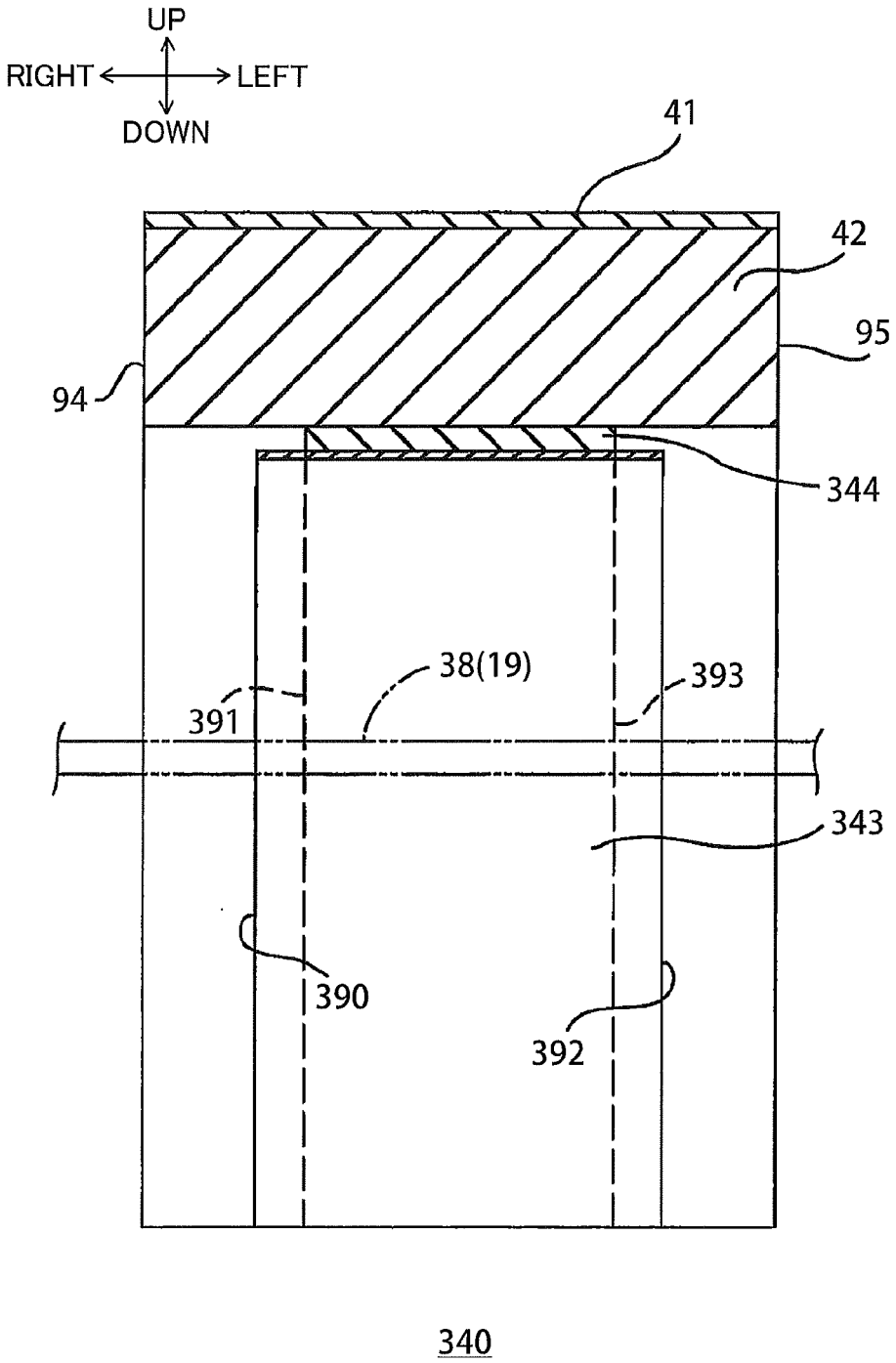
FIG. 9B is a vertical cross-sectional view of a cleaning member according to a third embodiment of the present invention

Next, a cleaning member 340 according to a third embodiment of the present invention will be described with reference to FIG. 9B. In the following description, like parts and components are designated by the same reference numerals with those of the first embodiment to avoid duplicating description.

The cleaning member 340 of the third embodiment includes a rigid member 343, a second double-sided tape strip 344 and the cushion member 42. Specifically, the left-right dimension of the rigid member 343 is shorter than the same dimension of the cushion member 42, and the left-right dimension of the second double-sided tape strip 344 is shorter than the same dimension of the rigid member 343. Thus, a right edge 390 of the rigid member 343 is positioned rightward from a right edge 391 of the second double-sided tape strip 344, and a left edge 392 of the rigid member 343 is positioned leftward from a left edge 393 of the second double-sided tape strip 344.

With the configuration according to the third embodiment described above, the rigid member 343 covers the second double-sided tape strip 344 from the side confronting the discharge wire 19, thereby restraining the second double-sided tape strip 344 from coming into contact with the discharge wire 19.

Further, the configuration according to the third embodiment described above can obtain the same operational advantages described in the first embodiment.

(3) Fourth Embodiment

Figure 9C:
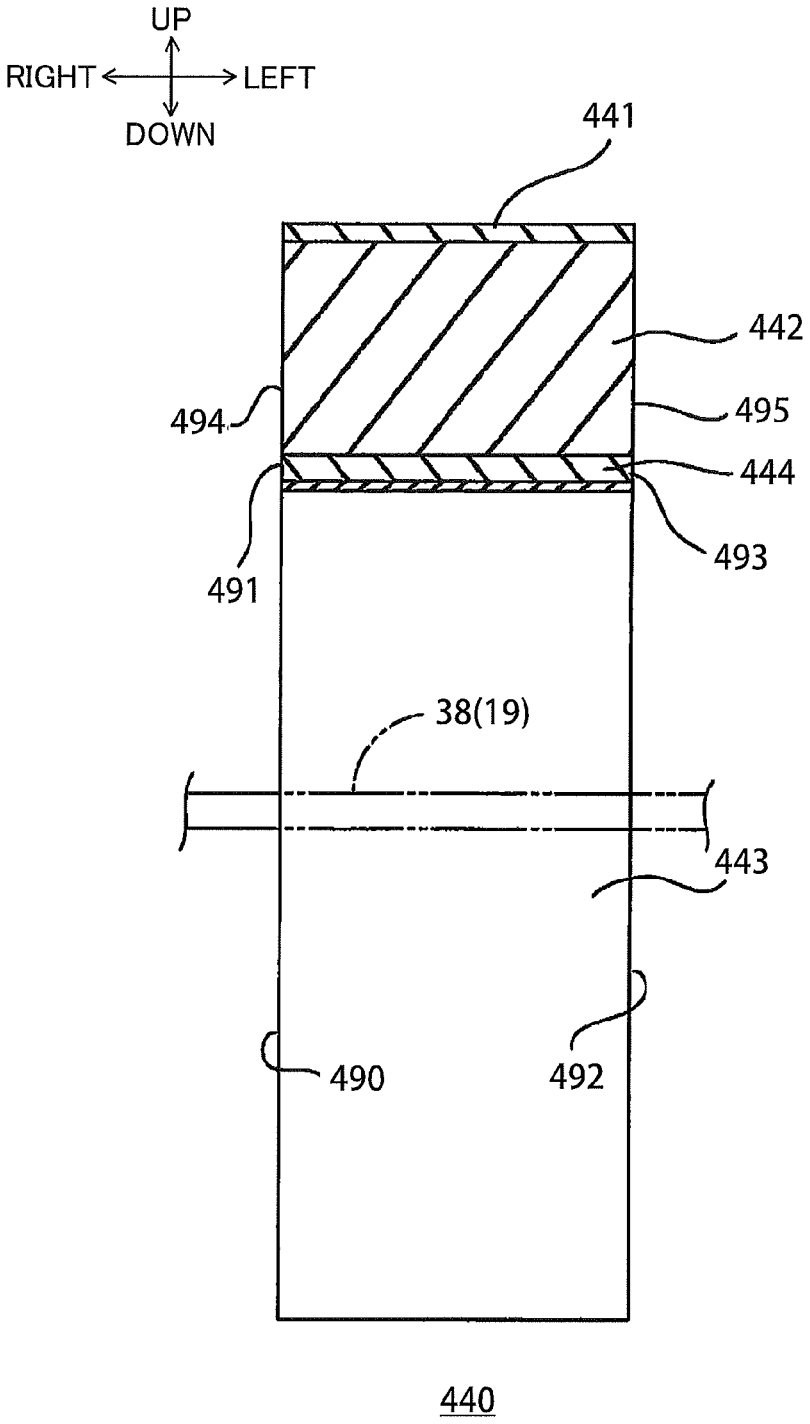
FIG. 9C is a vertical cross-sectional view of a cleaning member according to a fourth embodiment of the present invention

Next, a cleaning member 440 according to a fourth embodiment of the present invention will be described with reference to FIG. 9C. In the following description, like parts and components are designated by the same reference numerals with those of the first embodiment to avoid duplicating description.

The cleaning member 440 of the fourth embodiment includes a rigid member 443, a second double-sided tape strip 444, and a cushion member 442. Specifically, in the fourth embodiment, the left-right dimension of the rigid member 443 is equivalent to the same dimension of the cushion member 442 and the second double-sided tape strip 444 (and that of a first double-sided tape strip 441). Thus, a right edge 490 of the rigid member 443 is aligned with both a right edge 494 of the cushion member 442 and a right edge 491 of the second double-sided tape strip 444, and a left edge 492 of the rigid member 443 is aligned with both a left edge 495 of the cushion member 442 and a left edge 493 of the second double-sided tape strip 444 with respect to the left-right direction.

The configuration according to the fourth embodiment described above can obtain the same operational advantages described in the first embodiment.

6. Fifth Embodiment

Figure 10A:
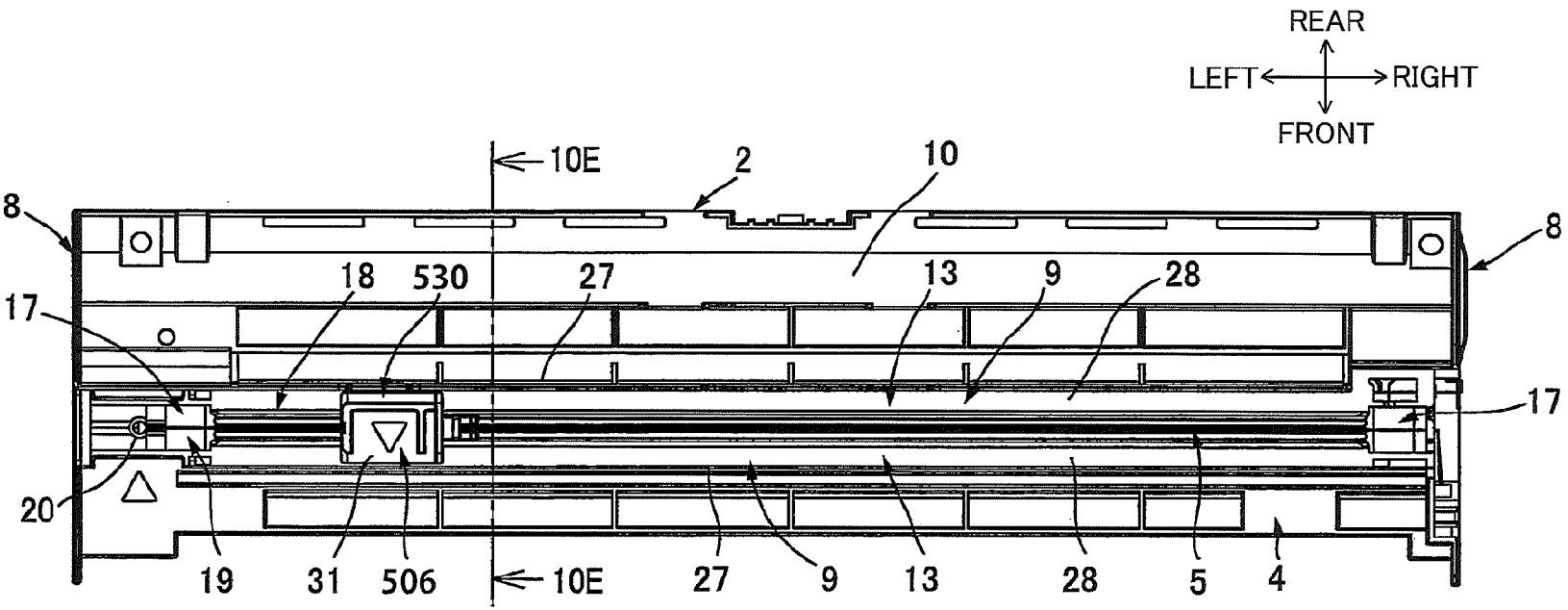
FIG. 10A is a plan view of a charging unit according to a fifth embodiment of the present invention.

Next, a cleaner 506 according to a fifth embodiment of the present invention will be described with reference to FIGS. 10A and 10B. In the following description, like parts and components are designated by the same reference numerals with those of the first embodiment to avoid duplicating description.

In the first embodiment, the cleaner 6 is configured to clean the wire 38 of the discharge wire 19. However, the cleaner 506 according to the fifth embodiment is configured to clean the ridge members 39 of the grid 18, as well as the wire 38 of the discharge wire 19.

Specifically, the cleaner 506 of the fifth embodiment includes a retaining frame 530 having a pair of sandwiching parts 100. The sandwiching parts 100 are disposed below the pair of coupling parts 32 and are spaced apart from each other in the front-rear direction. The sandwiching parts 100 have a general L-shape in a side view. Each sandwiching part 100 includes a wire-side fixing part 101, and a grid-side fixing part 102.

The wire-side fixing parts 101 have a rail-like shape that is elongated vertically. The wire-side fixing parts 101 extend downward from the bottom surface of the horizontal part 37 of the corresponding coupling part 32. The grid-side fixing parts 102 have a rail-like shape that is elongated in the front-rear direction. The grid-side fixing parts 102 are formed continuously with the bottom ends of the corresponding wire-side fixing parts 101 and extend outward therefrom relative to the front-rear direction.

The pair of sandwiching parts 100 supports a cleaning member 540 therebetween.

The cleaning member 540 is configured of a cushion member 542, a second double-sided tape strip 544 and a rigid member 543, as in the first embodiment. The cleaning member 540 of this construction is folded in half to form a general U-shape in a side view, with the opening of the "U" facing downward to provide a wire cleaning part 103 and grid cleaning parts 104.

The wire cleaning part 103 is disposed between the wire-side fixing parts 101 of the sandwiching parts 100. The wire cleaning part 103 has a general U-shape in a side view, with the opening of the "U" facing downward, such that the rigid member 543 is pressed against both left and right sides of the wire 38. The wire cleaning part 103 is adhesively fixed to the wire-side fixing parts 101 through a first double-sided tape strip 541.

The grid cleaning parts 104 are formed continuously with the bottom ends of the wire cleaning part 103, extending outward in respective front and rear directions. The grid cleaning parts 104 are disposed beneath the grid-side fixing parts 102 of the sandwiching parts 100. The grid cleaning parts 104 are adhesively fixed to the bottom surfaces of the grid-side fixing parts 102 through the first double-sided tape strip 541.

The grid cleaning parts 104 contact the ridge members 39 of the grid 18 from above with pressure. At this time, the cushion member 542 elastically deforms due to the pressure so that the rigid member 543 surrounds and contacts each ridge members 39 around its entire circumference, as shown in FIG. 10B. In other words, a portion of the rigid member 543 is positioned opposite to the cushion member 542 with respect to each ridge member 39. Thus, the rigid member 543 is made to wrap around the ridge members 39 in the circumferential direction thereof so as to contact the ridge members 39 uniformly around their circumference.

As in the cleaning operation described in the earlier embodiments, the retaining frame 530 of the cleaner 506 is moved rightward from its home position toward the cleaning position. Through this operation, the cleaning member 540 can clean the wire 38 as well as the ridge members 39.

Figure 10B:
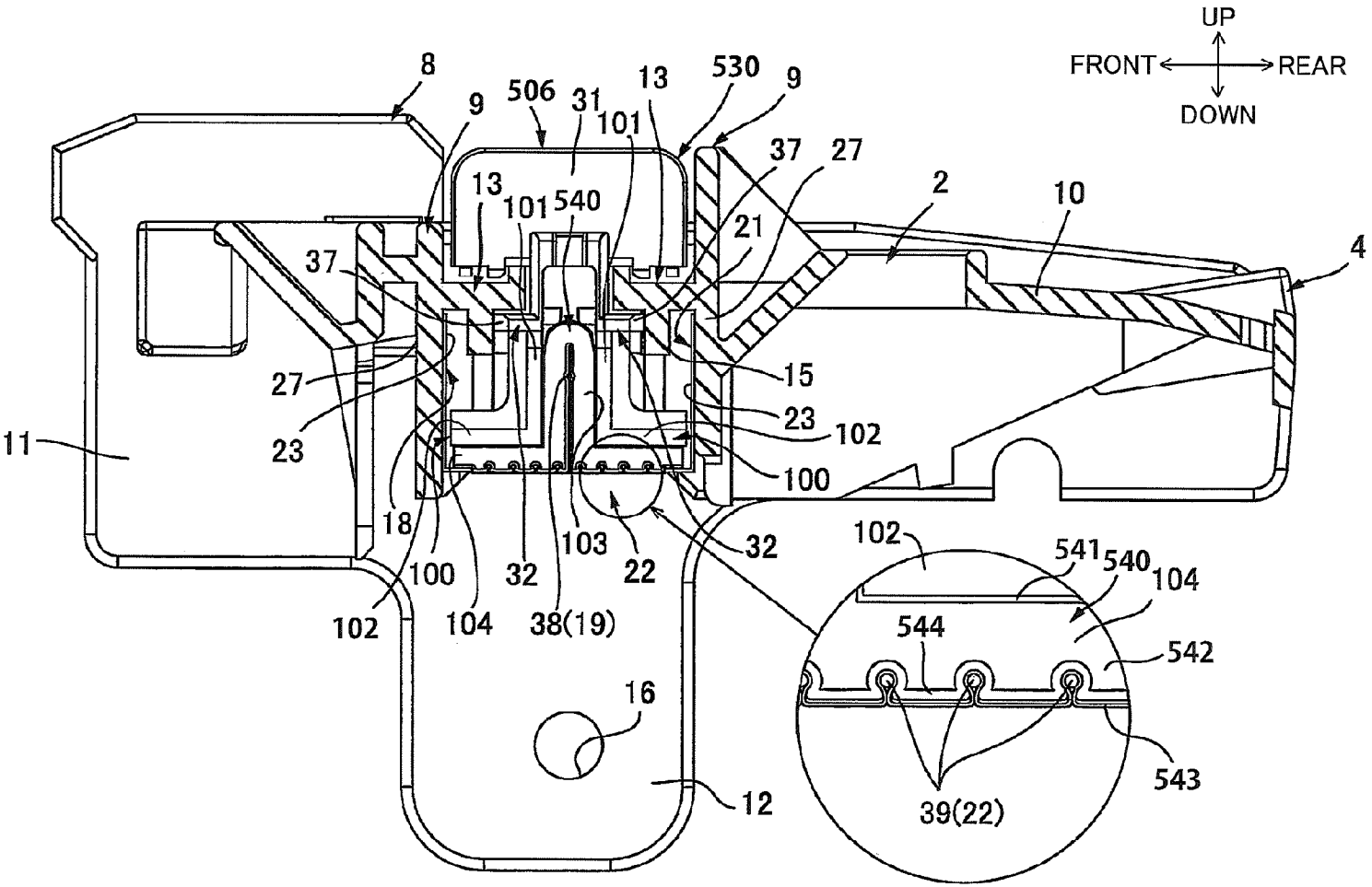
FIG. 10B is a cross-sectional view of the charging unit according to the fifth embodiment taken along a plane 10E-10E shown in FIG. 10A.

According to the fifth embodiment described above, the cushion member 542 supports the rigid member 543 so as to contact the wire 38 of the discharge wire 19 and the ridge members 39 of the grid 18, as illustrated in FIG. 10B. Accordingly, the rigid member 543 can be made to elastically contact the wire 38 and ridge members 39.

This construction enables the rigid member 543 to contact the wire 38 and ridge members 39 uniformly, ensuring that the rigid member 543 scrapes the wire 38 and ridge members 39 during an operation to clean the grid 18 and discharge wire 19. Thus, the cleaner 506 according to the fifth embodiment can reliably clean the discharge wire 19 and grid 18 in a single operation.

Further, the configuration according to the fifth embodiment described above can obtain the same operational advantages described in the first embodiment

7. Variations of the Embodiments

In the first through fifth embodiments described above, the charging unit 2 is provided in the drum cartridge 1 that is detachably mounted in the main casing 61, as shown in FIG. 1, but the present invention is not limited to this arrangement. For example, the photosensitive drum 51 and charging unit 2 may be provided in the main casing 61, while only the developing cartridge 69 may be detachably mounted in the main casing 61.

With this construction as well, the same operational advantages described in the first embodiment can be obtained.

Incidentally, the configurations of the above-described first through fifth embodiments can be combined appropriately.

While the invention has been described in detail with reference to the embodiments thereof, it would be apparent to those skilled in the art that various changes and modifications may be made therein without departing from the spirit of the invention.

What is claimed is:

1. A charging device comprising:

a discharge electrode extending in a first direction; and a cleaning member configured to move in the first direction to clean the discharge electrode, the cleaning member comprising:

a rigid member in contact with the discharge electrode; and a cushion member supporting the rigid member, the cushion member being positioned opposite to the discharge electrode with respect to the rigid member, the rigid member being positioned between the discharge electrode and the cushion member in a second direction perpendicular to the first direction.

2. The charging device as claimed in claim 1, wherein the rigid member makes surface contact with the discharge electrode.

3. The charging device as claimed in claim 1, wherein the cushion member is folded such that the discharge electrode is nipped by the rigid member.

4. The charging device as claimed in claim 1, wherein the rigid member has a first edge in the first direction and the cushion member has a second edge in the first direction, the first edge being positioned outward of the second edge in the first direction.

5. The charging device as claimed in claim 4, wherein the cleaning member further comprises an adhesive layer configured to adhere the rigid member and the cushion member, the adhesive layer having a third edge in the first direction, wherein the third edge is positioned inward of the first edge in the first direction.

6. The charging device as claimed in claim 1, wherein the rigid member has a first edge in the first direction and the cushion member has a second edge in the first direction, the first edge being positioned inward of the second edge in the first direction.

7. The charging device as claimed in claim 6, wherein the cleaning member further comprises an adhesive layer configured to adhere the rigid member and the cushion member, the adhesive layer having a third edge in the first direction, wherein the third edge is positioned inward of the first edge in the first direction.

8. The charging device as claimed in claim 1, wherein the rigid member has a first edge in the first direction and the cushion member has a second edge in the first direction, the first edge and the second edge being aligned with each other in the first direction.

9. The charging device as claimed in claim 1, further comprising a guide configured to guide the cleaning member to further move in the second direction while the cleaning member moves in the first direction, whereby the cleaning member moves in a direction sloping relative to the first direction.

10. A charging device comprising:

a discharge electrode extending in a first direction;

a grid electrode extending in the first direction and separated from the discharge electrode; and a cleaning member configured to move in the first direction to clean the grid electrode, the cleaning member comprising:

a rigid member in contact with the grid electrode; and a cushion member supporting the rigid member and configured to surround the grid electrode via the rigid member, the rigid member being positioned between the discharge electrode and the cushion member in a second direction perpendicular to the first direction.

* * * * *